United States Patent [19]

Fenner

[11] 4,087,031

[45] May 2, 1978

[54] BACKPACKING FRAME

[76] Inventor: Peter M. Fenner, 447 Mariomi Rd., New Canaan, Conn. 06840

[21] Appl. No.: 620,249

[22] Filed: Oct. 6, 1975

[51] Int. Cl.[2] ..... A45F 3/10

[52] U.S. Cl. ..... 224/25 A; 224/8 R

[58] Field of Search ..... 224/25 R, 25 A, 6, 8 R, 224/9, 5.1, 8 A, 10, 11, 12, 5 V, 5 W; 87/1 R, 1 A

[56] References Cited

U.S. PATENT DOCUMENTS

| | | | |
|---|---|---|---|
| 237,518 | 2/1881 | Gray | 224/5.1 X |
| 318,710 | 5/1885 | Egan | 224/5.1 X |
| 3,563,431 | 2/1971 | Pletz | 224/25 A |
| 3,733,017 | 5/1973 | Pletz | 224/25 A X |
| 3,734,366 | 5/1973 | Wood | 224/25 A |
| 3,897,894 | 8/1975 | Lawrence | 224/25 A |
| 3,902,640 | 9/1975 | Geiben | 224/5 W X |

FOREIGN PATENT DOCUMENTS

| | | | |
|---|---|---|---|
| 118,979 | 6/1942 | Australia | 224/8 R |
| 1,032,292 | 2/1951 | France | 224/8 R |
| 72,710 | 10/1944 | Norway | 224/25 A |
| 90,308 | 9/1957 | Norway | 224/8 R |
| 179,908 | 12/1935 | Switzerland | 224/25 A |

*Primary Examiner*—Trygve M. Blix
*Assistant Examiner*—Winston H. Douglas
*Attorney, Agent, or Firm*—Haight & Huard

[57] ABSTRACT

An improved backpacking frame is provided with a frame extending in spaced, conforming relationship behind and above the head of a wearer so that the pack can be positioned generally higher and more forward than conventionally supported packs. Additionally, one or more load carrying pouches can be attached to the improved frame so as to be worn across the chest of the wearer. The use of such an improved frame, alone or in combination with the companion pouches, provides the backpacker with an improved load carrying arrangement which facilitates comfortable walking.

8 Claims, 4 Drawing Figures

BACKPACKING FRAME

FIELD OF THE INVENTION

This invention relates to pack frames used to assist in carrying a load on a wearer's back. More particularly, this invention relates to such frames and an improved pack therefor which are suitable for recreational backpacking.

DESCRIPTION OF THE PRIOR ART

Backpacking has greatly increased in popularity in recent years, partly due to the general availability of improved equipment. One particular type of such improved equipment is the weight distributing pack frame used by a hiker to support a pack adjacent his back. Prior to widespread use of such frames, a hiker had to walk with the pack weight suspended from his shoulders by means of shoulder straps. With the advent of backpacking frames, a hiker can now mount his pack across one side of such a frame having shoulder straps attached to the other side thereof. Pieces of sponge rubber, webbing or similar spacing material are attached to the frame proximate the wearer's back and a waist belt is attached to the lower end of the frame. The spacing material holds the pack in spaced relation to the hiker's back to afford adequate ventilation and prevent contact with uncomfortable bulges in the pack. The spacing material and the waist belt cooperate to support the frame and pack proximate the wearer's back so that the load of such frame and pack combination may be comfortably carried by the wearer. By first hunching his shoulders upwardly, buckling the waist belt and then relaxing his shoulders, the hiker is able to shift approximately 75% of the load from his shoulders directly to his hips and legs. The hiker's shoulders are not only more comfortable because of the weight shift, but also are more freely movable than otherwise and therefore able to provide improved balance control.

An improvement in backpacking frames came with the advent of elongate contour frames which moved the center of gravity of the load borne by such frames higher and closer to the hiker's back, thus making it easier for him to shift the center of gravity of the load over his feet. Such frames, generally made from aluminum of magnesium alloy tubing, comprise a pair of elongate, spaced, parallel, interconnected vertical tube portions supported to extend from the wearer's head to a point below his waist. The tube portions have an elongate S-shape which generally conforms to the contour of the frame wearer's back. Such elongate contour frames permit the use of matching, thin, elongate packs which support their load close to the wearer's back. By loading such thin packs high on the frame, the center of gravity of such packs is relatively high. A slight lean forward by the hiker is all that is required to shift the center of gravity of the load over the hiker's feet and thereby properly balance the load. Additionally, waist belts are commonly employed with the contour frames to shift an additional portion of the load from the shoulders to hips and legs.

While such contour frames have been a substantial advance in the backpacking art, they are not without disadvantages. Even though the load of the pack can be shifted to the hips, it still acts from behind the body of the wearer, necessitating a slight forward lean which results in an unnatural, strained walking posture. Moreover, such a posture tends to force the hiker-wearer to look down and thus hinders his freedom of movement to observe visual stimuli around him. Additionally, such contour frames extend up behind the head of the wearer, thereby physically limiting his ability to move his head backward in order to look above the horizon.

OBJECTS OF THE INVENTION

Accordingly, it is a general object of this invention to provide a backpacking frame which facilitates optimal weight distribution directly over the legs and hips of a wearer.

Another object of this invention is to provide an improved pack assembly for use with a backpacking frame which facilitates such optimal weight distribution.

An additional object of this invention is to provide means whereby a conventional backpacking frame can be adapted to form a frame according to the present invention.

Still another object of this invention is to provide an improved backpacking frame which shifts the center of gravity of the load farther forward with respect to the body of the wearer than heretofore possible with known contour frames, thereby to allow the hiker to assume a more natural walking posture which additionally gives him freedom of movement to observe.

A further object of this invention is to provide such an improved backpacking frame which does not interfere with backward movement of the wearer's head.

Upon study of the specification and appended claims, additional objects and advantages of this invention will become apparent to those skilled in the art.

SUMMARY OF THE INVENTION

Briefly, the above and other objects are attained in one aspect of the present invention by providing a minor backpacking frame portion adapted for mounting to a backpacking frame having a major frame portion, said minor frame portion comprising a pair of upwardly extending, spaced, contour leg portions attachable at their lowermost ends to the top of said major frame portion, said leg portions being connected to each other at their uppermost ends via a transverse portion over the top of a wearer's head, said contour leg portions each comprising a first, generally parallel segment extending upwardly and rearwardly from said major frame portion so as to be spaced behind and in generally conforming relationship to the back of both the neck and head of a wearer of the backpacking frame, said contour leg portions each further comprising an upwardly extending second segment interconnecting said first segment with one end of said transverse portion, each of said second segments extending forwardly and inwardly towards said transverse portion so as to be spaced from and in generally conforming relationship to the contour along the top of the head of a wearer of the backpacking frame.

BRIEF DESCRIPTION OF THE DRAWINGS

The above and other objects, features and advantages of the present invention will become more fully apparent to those skilled in the art to which this invention pertains from the following detailed description, taken in conjunction with the annexed drawings, wherein like or corresponding reference characters refer to like or corresponding parts in the several Figures, and in which.

DETAILED DESCRIPTION

Figure 1:
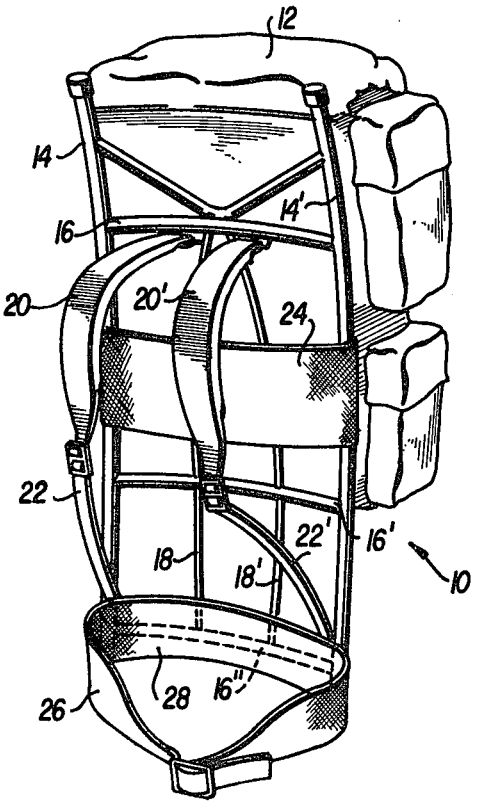
FIG. 1 is a perspective view of a contour backpacking frame and pack assembly well known in the prior art.

Referring to FIG. 1, a conventional contour backpacking frame assembly is illustrated. The assembly comprises a contour frame 10 which supports a pack 12 and a sleeping bag (not shown) by any conventional means. The frame comprises a pair of elongate, spaced, parallel, vertical tubular support members 14, 14' joined by a plurality of parallel, outwardly curved, transverse tubular support members 16, 16', 16'' which are strengthened by minor vertical support members 18, 18'. Adjustable, padded shoulder straps 20, 20' are attached at an upper end to the uppermost transverse member 16 via conventional fastening means (not shown) and are suitably tapered and spaced from each other so as not to chafe against the wearer's neck. The lower ends of padded shoulder straps 20, 20' are similarly attached to the frame near the lower ends of the vertical tubular support members 14, 14' via adjustable belts 22, 22'. A tensioned spacer band 24, extending between vertical supports 14, 14' and spaced between the upper and intermediate transverse members 16, 16', presses against the broad portion of the wearer's back to keep the frame and protruding pack contents from contact with the wearer's back as well as to permit ventilation between his back and the frame assembly. A padded, wraparound waist belt 26, attached to the lower end of support members 14, 14', facilitates an even distribution of pressure from the weight of the assembly circumferentially around the wearer's hips. The belt 26 includes a centrally disposed, integral weight distribution pad 28 which presses down across the small of the wearer's back. When such a conventional pack is properly worn, its elongate, tubular support members 14, 14' extend between a point below the waist of the wearer and a distant point adjacent or above the back of the wearer's head.

Figure 2:
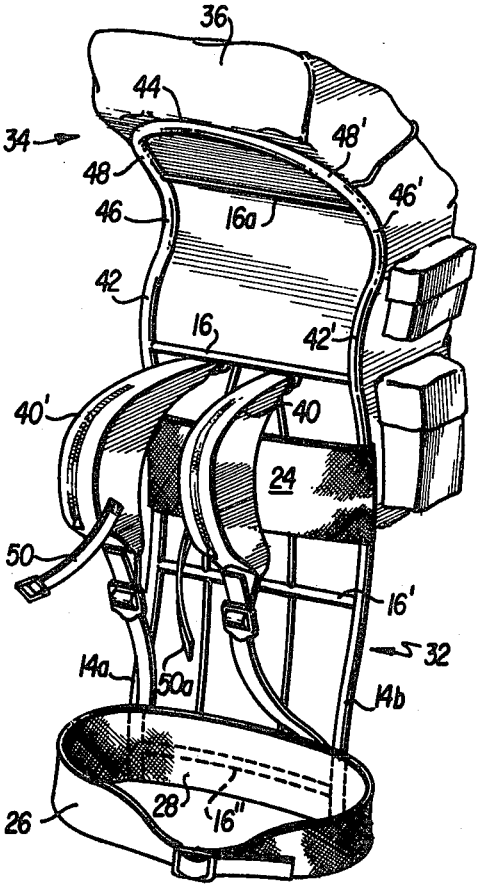
FIG. 2 is a perspective view of a contour backpacking frame and pack assembly of the present invention.

In contrast to the above and similar assemblies well known in the prior art, the present invention provides a backpacking frame assembly which permits complete distribution of the weight directly along the line of gravity of the wearer. Referring now to FIG. 2, the presently preferred embodiment of the backpacking frame and pack assembly of the present invention is shown. The overhead contour frame 30 comprises both a major frame portion 32 and a minor frame portion 34, and is adapted to support a mating pack 36 above and behind the head of the wearer. Major frame portion 32 is structured similar to a corresponding portion of the prior art frame shown in FIG. 1, and comprises a pair of spaced, elongated, parallel, tubular support members 14*a*, 14*b*, interconnected by transverse tubular support members 16, 16', 16''. The major frame portion 32 terminates proximate the uppermost transverse member 16, so that when this frame is worn, the major portion 32 will terminate at a point proximate the wearer's shoulders. This, of course, is contrasted with the prior art frame of FIG. 1 wherein elongate leg members 14, 14' of the frame extend substantially above the corresponding transverse member 16 and terminate proximate the top of the wearer's head. Thus, the prior art pack 12 positioned adjacent to the topmost portion of support members 14, 14' interferes with freedom of backward movement of the wearer's head.

Major frame portion 32 is conventionally attached to a pair of adjustable, padded shoulder pouch-straps 40, 40' (to be described in detail hereinafter), a conventionally attached wrap-around waist belt 26 and a weight distribution pad 28.

Overhead contour frame 30 further comprises a second, minor frame portion 34 comprising a pair of similar, contoured, spaced leg portions 42, 42' integrally connected respectively at their lowermost ends to the uppermost ends of the respective elongate support members 14*a*, 14*b* proximate to transverse member 16. Leg portions 42, 42' are integrally connected at their uppermost ends to an interconnecting, curved transverse end portion 44. The leg portions 42, 42' of the minor frame portion 34 are contoured so they will conform to the shape of the neck and the back and top portions of the head of the pack frame wearer. More specifically, leg portions 42, 42' each comprise a first segment 46, 46' which extends upwardly from the lowermost end of the respective leg portions 42, 42'. The first segments 46, 46' are shaped to follow the contour of the back of the frame wearer's neck and head in a spaced, generally parallel relation. The leg portions 42, 42' also each comprise a second segment 48, 48' which extends forward from the topmost portion of the first segments 46, 46' and integrally connects the respective first segments with transverse end portion 44. The second segments may be further connected to each other intermediate their ends by a transverse member 16*a* to provide increased load support capability for the frame. The second segments 48, 48' are shaped to follow the contour of the top of the frame wearer's head in a spaced, generally parallel relation thereto.

The matching pack 36 provided for overhead contour frame 30 is supported thereby so that one end of the pack 36 is attached by conventional means to the minor frame portion at one or more points above the head of the wearer. The pack 36 extends rearwardly from the point of attachment above the wearer's head, over the minor frame portion, down to the major frame portion 32, where it is conventionally attached at its other end to a point or points along elongate tubular support members 14*a*, 14*b*.

Figure 3:
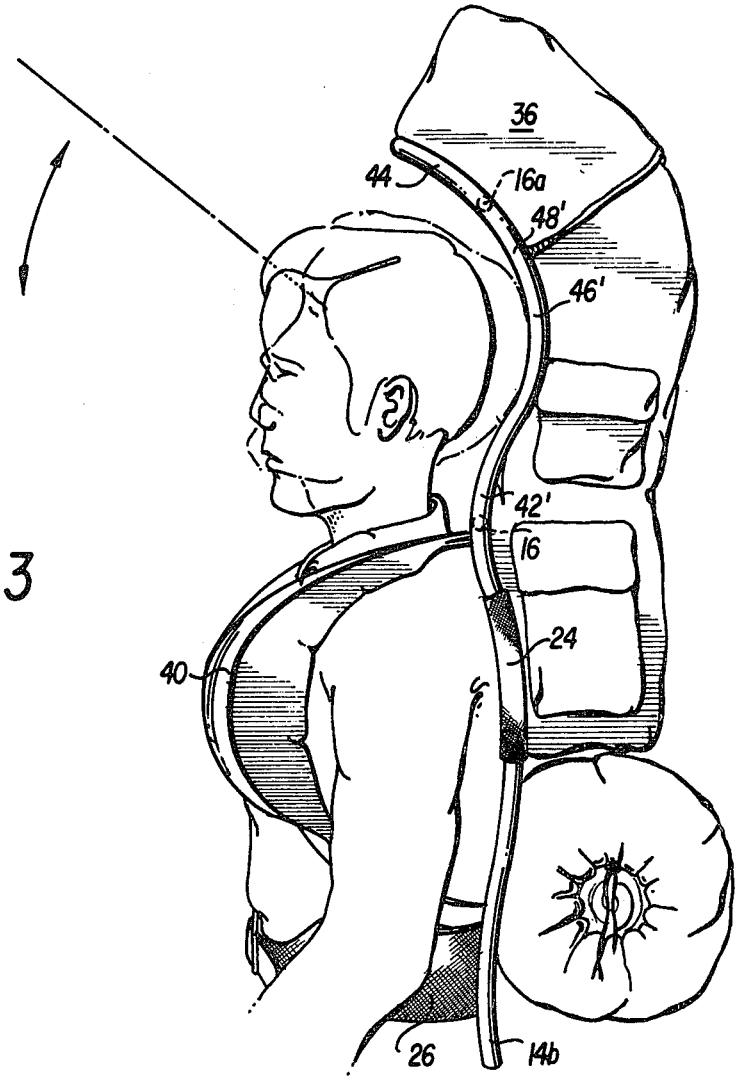
FIG. 3 is an elevation view of the frame of FIG. 2 as it would be worn by a wearer, thus illustrating the freedom of head movement permitted thereby.

Referring to FIG. 3, the greater freedom of head movement which is provided by the improved overhead contour frame of the present invention is schematically illustrated. Because of the clearance provided around the arc formed by the back of the head when looking above the horizon, a wearer of the overhead contour frame of the present invention can now see farther above the horizon than was previously possible. In addition, FIG. 3 illustrates how the frame of FIG. 2 supports its load closer to the center of gravity and higher up the body of the wearer than is possible with a conventional prior art frame.

While highly suitable for walking over relatively flat terrain, the center of gravity in addition to being moved forward is likewise moved higher from the ground, making the load unstable when skiing, climbing or hiking over difficult terrain. To counteract this tendency, the pack can be loaded so as to lower the center of gravity, but this sacrifices to some extent the forward positioning thereof over the hips. Alternatively, in a preferred embodiment of the present invention, a pair of chest pouches 40, 40' may be employed which preferably form an integral part of padded shoulder straps 20, 20'. In this alternative, separate pouches can be employed which are detachably fastened to conventional shoulder straps 20, 20' of the type shown in FIG. 1. The pouches are interconnected by a detachable retaining strap **50, 50*a*** which holds the pouches in place across the wearer's chest against the forces exerted thereon. These pouches serve a dual function. First, they allow the wearer of the overhead contour frame to shift a portion of the load to the front of his body; in combination with the frame of the present invention, this gives the wearer greater balance and permits a more comfortable, erect posture during walking. Additionally, the use of such pouches gives the wearer ready access to their contents without the necessity of removing the pack. The pouches are suitably constructed of the same material of which the pack is made, and may have zipper or Velcro closure means to permit easy access to the contents thereof.

Figure 4:
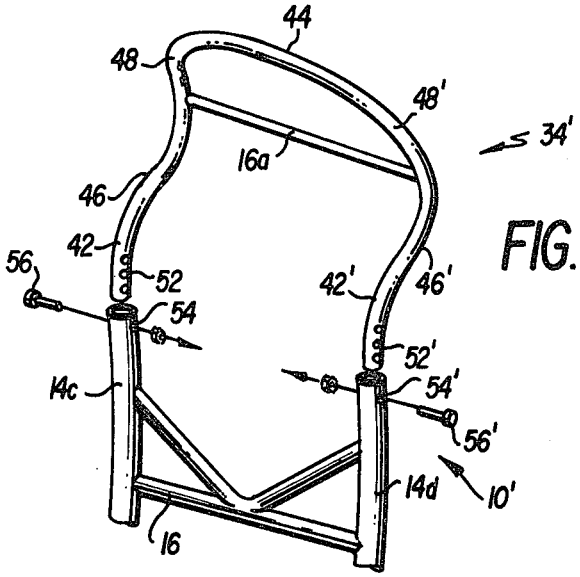
FIG. 4 is a perspective view of a detachable second frame portion, in accordance with an alternative embodiment of the present invention, disposed for attachment to a conventional prior art frame which has been modified to receive the detachable second frame portion.

One advantage of the backpacking frame of the present invention lies in its adaptability to utilize conventional frame elements and design from the shoulder strap support bar on down. Thus, the novel minor frame portion of the present invention can be adapted to existing equipment by shortening the vertical supporting frame members thereof and adapting them for mating with the novel minor frame portion of the present invention by means known in the art, e.g. analogously to the adjustable pack frames described in U.S. Pat. Nos. 3,563,431; 3,648,907; 3,733,017; and 3,734,366. Referring to FIG. 4, a prior art frame 10 of the type illustrated in FIG. 1 is provided, the uppermost portion of vertical tubular support members 14, 14' being cut down to a point just above transverse member 16 to form a modified frame 10'. An inverted, generally U-shaped, minor frame portion 34' is provided which is adapted to be mated with the modified frame 10'. The minor frame portion or conversion member 34' comprises a pair of similar, parallel, contoured leg portions 42, 42' which are integrally connected at their uppermost ends to transverse end portion 44. Additionally, a transverse leg member **16*a* is optionally provided, connecting leg portions 42, 42' intermediate their respective ends. The parallel leg portions 42, 42' of conversion member 34' are here shown adapted for mating with modified tubular support members 14*c*, 14*d* of the modified prior art pack frame 10' by being provided with a plurality of horizontally spaced, parallel apertures 52, 52' drilled across the tubular diameter thereof in radial alignment with apertures 54, 54' so that fastening pins 56, 56' can pass through both sets of aligned apertures after leg portions 42, 42' have been snugly fitted into or around tubular support members 14*c*, 14*d*** to concentrically overlap for several inches.

Let portions 42, 42' once connected to the modified frame 10', extend upwardly along first segments 46, 46' in a spaced and generally conforming parallel relation to the dorsal contour of a wearer's neck and head, either generally parallel to each other or preferably angling slightly towards each other. Integrally formed second segments 48, 48' extend forwardly from a point approximately behind the dorsalmost portion of a wearer's head in a similarly spaced, generally conforming parallel relation to the contour of the top of a wearer's head and terminate in integral transverse end portion 44 above the anterior and ventral portions of the wearer's head.

A plurality of conventional pack fastening means (not shown) are provided on transverse end portion 44 and are suitably spaced along the length of first and second segments 46, 46', 48, 48', respectively, of leg portions 42, 42' so that a pack will be positioned along substantially the entire length of minor frame portion 34'. As with the integrally formed overhead contour frame of FIG. 2, the center of gravity for the pack and frame assembly is accordingly moved forward from that of the prior art assemblies, e.g. on modified frame 10', to balance the weight thereof at a point closer to the wearer's spine, hips and legs while providing greater freedom of movement.

As is illustrated in FIG. 3, by use of the frame structure shown in FIGS. 2 or 4 of the drawings, the wearer is thus able to freely move his head backward without interference from the frame which inherently occurs with the elongate frame members of the prior art. Consequently, the wearer of the improved frame of the present invention can readily lift his head to see far above the horizon without hindrance from the adjacent pack frame.

The arrangement of the pack frame of the present invention offers the further advantage of supporting the load carried therein closer to and higher up the wearer's back than was heretofore possible. Since the center of gravity of the assembly is closer to that of the carrier, very little forward lean is required to achieve optimal balance while walking, and the wearer can comfortably walk with an erect or near erect posture. Particularly with the loads both in front of and behind the wearer, the composite center of gravity of the pack and frame assembly will be located at a point intermediate the centers of gravity of the individual loads, whereby the wearer may walk perfectly erect and balanced.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A backpacking frame having a major frame portion to support a mating pack above and behind the head of a wearer without interfering with backward movement of the wearer's head, said major frame portion including a pair of interconnected, spaced, elongate members adapted to be supported parallel to a wearer's back extending from his shoulders to a point below his waist to conform generally with the shape of his spine, the major frame portion further including a wrap-around waist belt attached to said elongate members and adapted to be disposed about the waist of the wearer;

said backpacking frame having a minor frame portion comprising a pair of upwardly extending, spaced, contour leg portions attachable at their lowermost ends to the top of said major frame portion, said leg portions being connected to each other at their uppermost ends via a transverse portion disposed over the top of a wearer's head, said contour leg portions each comprising a first, generally parallel segment extending upwardly and rearwardly from said major frame portion so as to be spaced behind and in generally conforming relationship to the back of both the neck and head of a wearer of the backpacking frame, said contour leg portions each further comprising a second upwardly extending segment interconnecting said first segment with one end of said transverse portion, each of said second segments extending forwardly and inwardly towards said transverse portion so as to be spaced from and in generally conforming relationship to the contour along the top of the head of a wearer of the backpacking frame;

said minor frame portion being connected with and extending upwardly from said major frame portion such that a pack to be supported can be attached at an upper end to said minor frame portion above the wearer's head and be attached at a lower end to the major frame portion; and a pair of shoulder straps supported from opposite sides of said major frame portion and adapted to be engaged by a wearer over his shoulders and down his chest, said straps each supporting a pouch on one side of the wearer's chest to allow the wearer to shift a portion of the packframe load to the front of his body.

2. The backpacking frame of claim 1, further comprising means to detachably secure said minor frame portion to said major frame portion.

3. The backpacking frame of claim 1, further comprising a transverse leg member interconnecting said parallel leg portions intermediate their respective ends above the head of said wearer to provide the minor frame portion with increased load carrying capacity.

4. The backpacking frame of claim 1, wherein the contour leg portions of said minor frame portion are each integrally attached to one of said elongate members.

5. The backpacking frame of claim 4, further comprising a mating pack attached to said minor frame portion.

6. The backpacking frame of claim 1, wherein the minor frame portion further comprises a transverse leg member interconnecting said contour leg portions intermediate their respective ends.

7. The backpacking frame of claim 1, wherein said pouches are provided with means for interconnection thereof across the wearer's chest.

8. The backpacking frame of claim 7, wherein the contour leg portions of said minor frame portion are each integrally attached to one of said elongate members and wherein the minor frame portion further comprises a transverse leg member interconnecting said contour leg portions intermediate their respective ends.

* * * * *